US005828767A

United States Patent [19]

Button

[11] Patent Number: 5,828,767

[45] Date of Patent: Oct. 27, 1998

[54] INDUCTIVE BRAKING IN A DUAL COIL SPEAKER DRIVER UNIT

[75] Inventor: Douglas J. Button, Los Angeles, Calif.

[73] Assignee: JBL Inc., Northridge, Calif.

[21] Appl. No.: 934,642

[22] Filed: Sep. 22, 1997

[51] Int. Cl.[6] ..... H04R 25/00

[52] U.S. Cl. ..... 381/195; 381/96; 381/194

[58] Field of Search ..... 381/195, 194, 381/192, 199, 96, 59

[56] References Cited

U.S. PATENT DOCUMENTS

| | | | |
|---|---|---|---|
| 3,047,661 | 7/1962 | Winker | 381/96 |
| 5,371,806 | 12/1994 | Kohara et al. | 381/194 |
| 6,609,784 | 9/1986 | Miller | 381/96 |

*Primary Examiner*—Huyen Le
*Attorney, Agent, or Firm*—J. E. McTaggart

[57] ABSTRACT

An electro-magnetic loudspeaker, with dual voice coils operating in corresponding magnetic fields in annular gaps between permanent magnet pole pieces, is provided with a single short-circuited braking coil of one or more turns mounted on the voice coil form midway between the two voice coils. The braking coil has minimal effect on normal operation of the loudspeaker, but introduces an inductive braking effect from counter-EMF whenever the voice coil assembly displacement approaches a working limit in either direction, as the braking coil enters a corresponding one of the two magnetized gaps. Thus bidirectional braking/damping is accomplished in a dual coil speaker by the addition of a single braking coil, which could be simply a one turn ring; whereas bidirectional inductive braking in a speaker with a single voice coil requires two such braking coils flanking the voice coil. The single braking/damping coil can be brought out to terminals for connecting it in a loop circuit with an active feedback driver and/or a network of one or more reactive components, for modifying and enhancing the braking/damping action.

8 Claims, 2 Drawing Sheets

INDUCTIVE BRAKING IN A DUAL COIL SPEAKER DRIVER UNIT

FIELD OF THE INVENTION

The present invention relates to the field of audio loudspeakers, and more particularly it relates to an improvement in a dual voice coil loudspeaker that provides inductive braking of the voice coil/diaphragm assembly as it approaches its working travel limits in both directions.

BACKGROUND OF THE INVENTION

There has been strong motivation to design loudspeakers for increased power handling capability. Technology advances have facilitated the generation of high levels of audio power, however mechanical limitations of loudspeakers place limits on the level of acoustic power that can be obtained, particularly the travel limits of the voice coil/diaphragm assembly.

The inherent magnetic damping factor due to counter-EMF, characterizing the "tightness" of the magnetic drive system, is primarily a function of magnetic flux density, however the damping factor typically varies as a function of the position of the vibrating voice coil as it moves through the magnetic field: typically the damping factor decreases as the voice coil moves toward the limit of travel in either direction. The stiffness of the suspension of the moving system makes a contribution to damping factor that is also a function of the position of the voice coil within its travel range; and since, contrary to the magnetic damping, the suspension damping increases toward the travel limits, it is commonly relied upon as the main safeguard against bottoming, i.e. striking a hard constraint or even straining the suspension to its limit, which of course can introduce serious distortion and risk of physical damage or deterioration.

With high audio power readily available, along with a large influence of different enclosures and baffles on the high power level performance and overload properties of speakers especially at low bass frequencies, there is a widespread and increasing need for speaker design innovations that will preserve fidelity and performance under extremely high power drive levels and in a variety of enclosures, and that will better protect against the risk of bottoming.

DISCUSSION OF RELATED KNOWN ART

Inductive braking/damping has been applied to single voice coil loudspeakers by introducing a short-circuited winding positioned such that it enters a strong magnetic field across an air gap, typically between permanent magnet poles forming the working air gap of the voice coil, as the vibrating assembly nears its working travel limit; counter-EMF from the induced current tends to damp or brake the voice coil movement as a function of its velocity relative to the magnetic field.

U.S. Pat. No. 4,160,133 to Wiik exemplifies the foregoing principle of magnetic damping, claiming ". . . a short-circuit ring (on) at least one end of" the "voice coil," the "ring . . . located outside the air gap when . . voice coil is in its neutral position". This patent teaches that with a single voice coil, two such rings are required in order to introduce inductive braking/damping at the excursion limits in both directions.

U.S. Pat. No. 4,598,178 to Rollins, utilizing the foregoing principle of magnetic damping, brings the ends of the auxiliary winding out to a pair of terminals that can be short-circuited or alternatively utilized to introduce reactance by connecting capacitive and/or inductive components to introduce frequency-selective effects. Rollins teaches braking/damping as applied only at one end of the excursion range: in the forward direction.

U.S. Pat. No. 4,628,154 to Kort configures the magnet system to provide an auxiliary air gap magnetic field that acts on the voice coil to provide inductive braking/damping at one end of the excursion range; the rearward end.

German patent 92-218457/27 and European patent 492142-A2 to Fleischer show inductive damping/braking utilizing two short-circuited auxiliary windings flanking a single voice coil.

For improving the overall performance of loudspeakers, it has been proposed to utilize dual voice coil windings each operating in a separate annular magnetic gap. As examples, British patent 705,100 to Wolff and French patent 1,180,456 to Kritter, disclose such dual voice coil approaches.

OBJECTS OF THE INVENTION

It is a primary object of the present invention to provide inductive braking/damping in a dual voice coil loudspeaker.

It is a further object to provide such inductive braking/damping bidirectionally, i.e. acting in both directions in regions of maximum voice coil excursion.

It is a still further object to provide such bidirectional inductive damping with minimal complexity, cost and added mass in the vibrating system.

It is a still further object to implement such bidirectional braking/damping in a manner that it can be modified by the introduction of a passive network having one or more reactive components into a loop circuit including a single braking/damping element.

It is a further object to implement such bidirectional braking/damping in a manner that it can be modified by the introduction of active feedback into a loop circuit including a single braking/damping element.

SUMMARY OF THE INVENTION

The abovementioned objects have been accomplished by the present invention of inductive braking/damping in a dual voice coil loudspeaker by introducing a short-circuited auxiliary winding of at least one turn, generally located midway between two voice coils of a dual voice coil loudspeaker, and configuring and arranging the magnetic system and voice coil structures such that the auxiliary coil enters a first of the two magnetic gaps in approaching maximum voice coil excursion in a first direction and enters the second of the two magnetic gaps in approaching maximum voice coil excursion in a second direction opposite the first direction. Thus with only one short-circuited auxiliary winding, bilateral inductive braking/damping is accomplished in a dual voice coil loudspeaker.

A scientific paper entitled "Magnetic Circuit Design Methodologies for Dual Coil Transducers", scheduled for presentation by the inventor as author at the 103rd Convention of the Audio Engineering Society in New York, N.Y. on Sep. 26, 1997, addresses dual voice coil technology and includes a discussion of aspects of the present invention.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
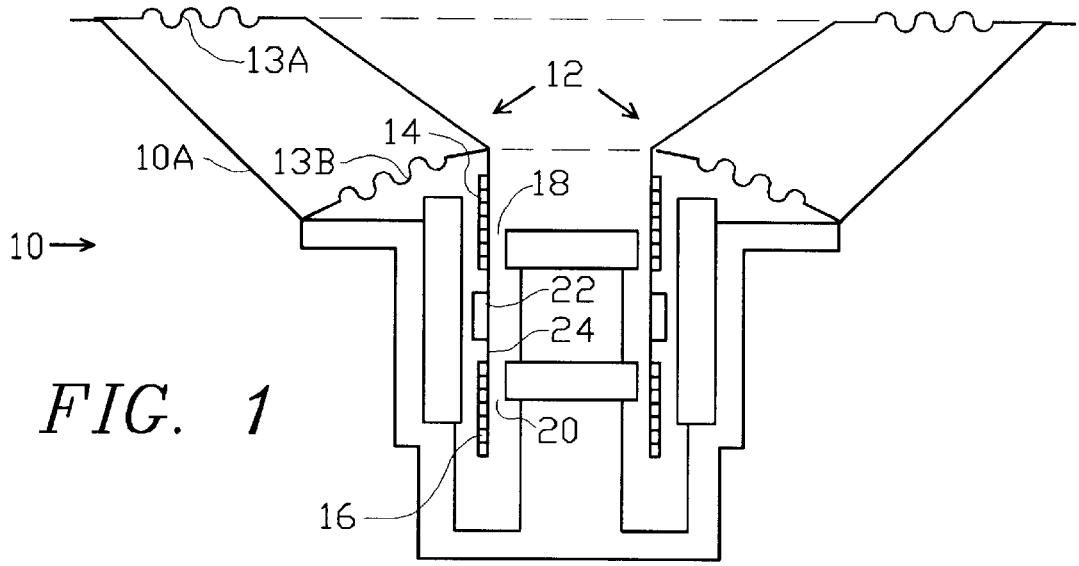
FIG. 1 is a cross-section representing a dual voice coil loudspeaker with the diaphragm/voice coil assembly at its quiescent center position.

FIG. 1 is a cross-section representing a dual voice coil loudspeaker 10 [with the] having a frame consisting mainly of a basket portion 10A, and having a vibratable [cone/] voice coil/diaphragm assembly 12 including (a) a tubular voice coil form portion carrying two voice coils 14 and 16, and (b) a conical diaphragm portion vibratably suspended from the frame by resilient suspension members 13A and 13B known as "surround" and "spider" suspensions respectively, which, in accordance with well-known practice in loudspeakers, allow assembly 12 to vibrate along its central axis. Assembly 12 is shown at its quiescent center position, where it is seen that voice coils 14 and 16 each have a portion located in a corresponding one of magnetic gaps 18 and 20, polarized as indicated by N and S, and each of these portions is acted upon over the full length of the magnetic gap. While voice coils 14 and 16 each may be offset, as shown, relative to the corresponding magnetic gaps 18 and 20, the two offsets tend to cancel each other so that the coils 14 and 16 function in a complementary manner that provides a large excursion of travel over which the drive force and damping remain relatively constant. A short-circuited braking coil 22 having one or more turns is located midway between voice coils 12 and 14, affixed to the voice coil form 24.

Figure 2:
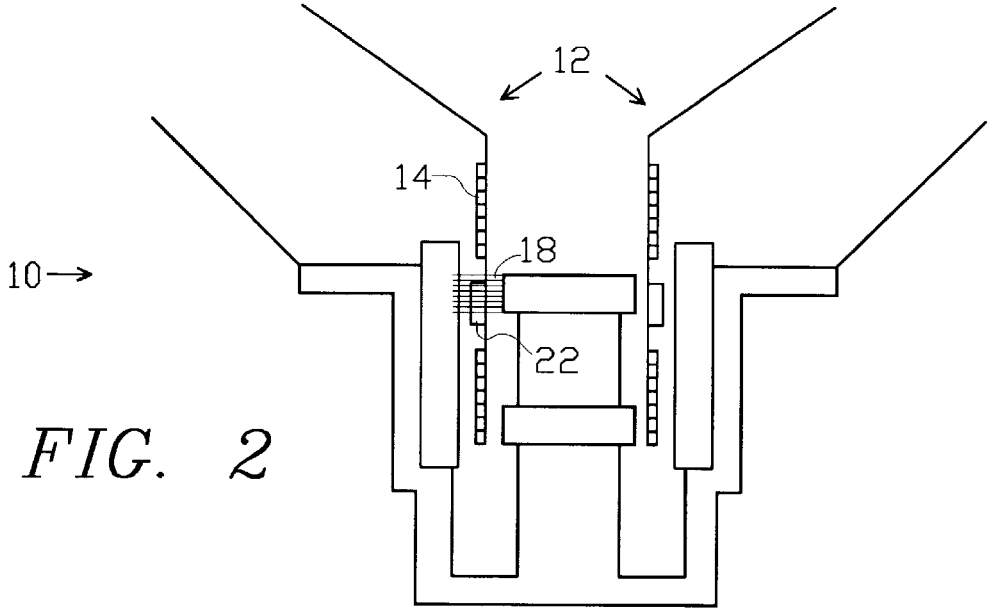
FIG. 2 shows the loudspeaker of FIG. 1 with the voice coil assembly displaced in a first direction sufficiently to invoke inductive braking/damping.

FIG. 2 shows the loudspeaker 10 of FIG. 1 with the voice coil/diaphragm assembly 12 displaced in a first direction (upwardly, as shown) and approaching the limit of the travel range. Inductive braking/damping is invoked by braking coil 22 moving into magnetized air gap 18 indicated by dashed flux lines. The movement of braking coil 22 relative to the magnetic field induces a current in braking coil 22, and counter-EMF exerts a braking/damping force on the voice coil/diaphragm assembly 12 via braking coil 22, acting to decrease the velocity of (upward) travel and thus limit the excursion smoothly as opposed to abrupt bottoming due to mechanical striking or reaching the limit of the suspension compliance that could occur otherwise.

Figure 3:
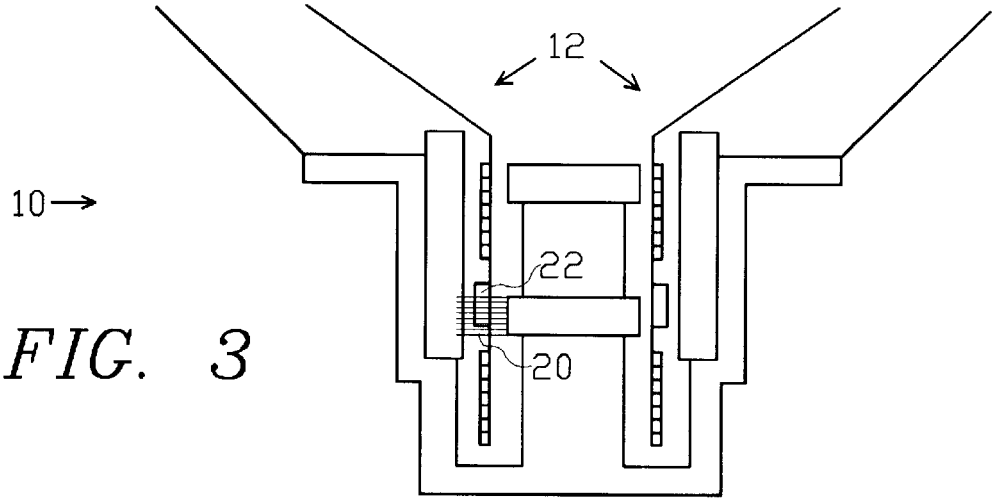
FIG. 3 shows the loudspeaker of FIGS. 1 and FIG. 2 with the voice coil assembly displaced in a second direction, opposite that shown in FIG. 2, sufficiently to invoke inductive braking/damping.

FIG. 3 shows the loudspeaker 10 of FIGS. 1 with the voice coil/diaphragm assembly 12, displaced in a second direction (downwardly, as shown), with braking coil 22 moving into magnetized gap 20 and thus invoking the inductive braking/damping action in the same manner as described above in connection with FIG. 2.

Thus the present invention provides symmetrical braking/damping in a dual voice coil loudspeaker 10 in combination with a single short-circuited braking coil 22.

Figure 4:
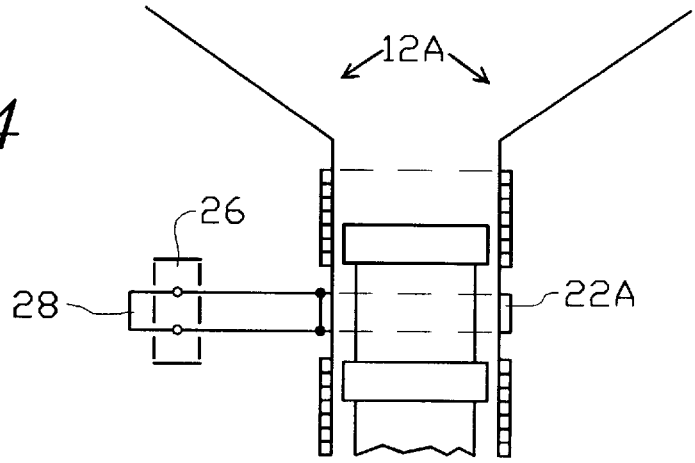
FIG. 4 shows the diaphragm/voice coil assembly of a loudspeaker similar to that in FIGS. 1–3 except that the ends of the braking coil brought out to a terminal board, shown with a short-circuiting jumper connected across the terminals.

FIG. 4 shows a voice coil/diaphragm assembly 12A of a loudspeaker as in the previous figures but with the ends of the braking coil 22A brought out to a terminal board 26, shown with a jumper 28 connected across the terminals, effectively short-circuiting the braking coil 22A and thus enabling it to function in the same manner as the directly short-circuited braking coil 22 described above in connection with FIGS. 1–3.

Figure 5:
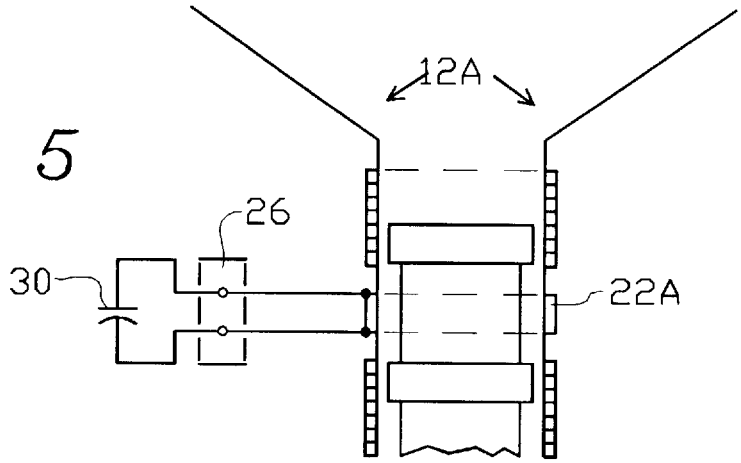
FIG. 5 shows the diaphragm/voice coil assembly and terminal board as in FIG. 4, but with a capacitor connected across the terminals.

FIG. 5 shows the voice coil/diaphragm assembly 12A as in FIG. 4 but with the terminals of board 26 connected to a capacitor 30 as an example of a reactive component or network of components that can be thus connected in a circuit loop including the braking coil 22A in order to introduce a frequency-dependent modification to the basic braking effect.

Figure 6:
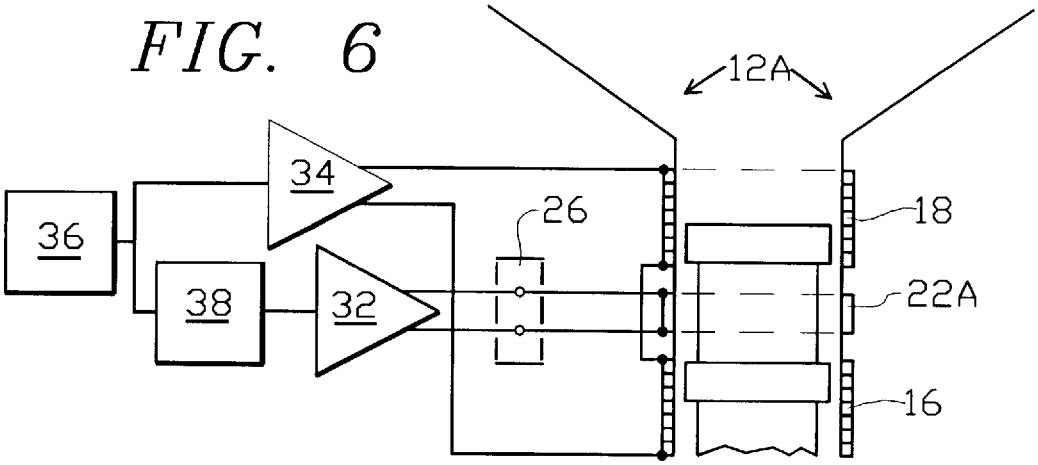
FIG. 6 shows the diaphragm/voice coil assembly and terminal board as in FIG. 4 but with a feedback driver connected across the terminals, also showing a main driver connected to the dual voice coils.

FIG. 6 shows an actively-enhanced inductive braking system in which the voice coil/diaphragm assembly 12A is configured as in FIG. 4 except that the terminals of board 26 are connected to a feedback driver 32. A main amplifier/driver 34, driving the dual voice coils 16 and 18, receives input from an audio source 36. Feedback driver is preceded by a special processor 38 which may receive input from audio source 36 as shown or alternatively the input could be obtained at any of several signal nodes in the main amplifier signal path through amplifier/driver 34. The frequency and amplitude response of processor 38 can be flexibly modified to provide a feedback current in braking coil 22A that co-operates with induced current in a manner to augment and enhance the braking action in a desired manner.

Referring again to FIG. 1, the invention could be practiced with the magnetic polarities N and S reversed compared to those shown.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A bidirectional inductive braking system, in a dual voice coil electro-magnetic audio loudspeaker, comprising:

a frame of said loudspeaker;

a vibratable voice coil/diaphragm assembly of said loudspeaker having a cylindrical voice coil form;

suspension means for resiliently mounting said voice coil/diaphragm assembly to said frame;

a first voice coil affixed to the voice coil form disposed within a first magnetic field that traverses a first annular gap;

a second voice coil, affixed to the voice coil form spaced from the first voice coil by a voice coil spacing dimension, disposed within a second magnetic field that traverses a second annular gap spaced from the first annular gap by a gap spacing dimension; and a short-circuited braking coil comprising at least one turn located on the voice coil form substantially midway between said first voice coil and said second voice coil;

the voice coils and the magnetic fields being relatively dimensioned and arranged to cause said braking coil, (a) upon approaching a first limit of working displacement, to enter the first magnetic field and thus exert a braking force on said voice coil/diaphragm assembly, and (b) upon approaching a second limit of working displacement opposite the first limit thereof, to enter the second magnetic field and thus exert a braking force on said voice coil/diaphragm assembly; thus said braking coil is enabled to bilaterally constrain excursions of said voice coil/diaphragm assembly.

2. An improvement providing inductive braking in a dual voice coil electro-magnetic audio loudspeaker of a type having first and second voice coils on a cylindrical voice coil form of a voice coil/diaphragm assembly vibratably mounted to a frame of the loudspeaker by resilient suspension means, the voice coils being disposed within first and second magnetic fields in first and second gap regions between corresponding permanent magnet poles, the improvement comprising:

a short-circuited braking coil affixed to the voice coil form substantially midway between said first voice coil and said second voice coil and disposed coaxially therewith;

the voice coils and the magnetic fields being relatively dimensioned and arranged to cause said braking coil, (a) upon approaching a first limit of working displacement, to enter the first magnetic field and thus exert a braking force on said voice coil/diaphragm assembly, and (b) upon approaching a second limit of working displacement opposite the first limit thereof, to enter the second magnetic field and thus exert a braking force on said voice coil/diaphragm assembly;

whereby said braking coil is enabled to bilaterally constrain travel of said voice coil/diaphragm assembly at the two opposite limits of displacement.

3. The improvement providing inductive braking in a dual voice coil electro magnetic audio loudspeaker as defined in claim 2 wherein said short-circuited braking coil comprises a single turn configured as a ring.

4. The improvement providing inductive braking in a dual voice coil electro magnetic audio loudspeaker as defined in claim 2 wherein said short-circuited braking coil comprises a multi-turn coil having two wire ends connected together so as to short-circuit said braking coil.

5. A bidirectional inductive braking system in a dual voice coil electro-magnetic audio loudspeaker having dual voice coils in a vibrating voice coil/diaphragm assembly driven from an audio source, said braking system comprising:

a frame of said loudspeaker;

a vibratable diaphragm assembly having a cylindrical voice coil form;

suspension means for mounting said diaphragm assembly to said frame;

a first voice coil affixed to the voice coil form disposed within a first magnetic field that traverses a first annular gap;

a second voice coil, affixed to the voice coil form spaced from the first voice coil by a voice coil spacing dimension, disposed within a second magnetic field that traverses a second annular gap spaced from the first annular gap by a gap spacing dimension; and a braking coil comprising at least one turn located on the voice coil form substantially midway between said first voice coil and said second voice coil, said braking coil being configured and arranged to have two electrical nodes each corresponding to an end thereof;

a pair of terminals, connected respectively to the two nodes of said braking coil;

braking coil enabling means having two nodes connected to said pair of terminals so as to form a loop circuit including said braking coil and said braking coil enabling means;

the voice coils and the magnetic fields being relatively dimensioned and arranged to cause said braking coil, (a) upon approaching a first limit of working displacement, to enter the first magnetic field and thus exert a braking force on the voice coil/diaphragm assembly, and (b) upon approaching a second limit of working displacement opposite the first limit thereof, to enter the second magnetic field and thus exert a braking force on the voice coil/diaphragm assembly; thus said braking coil is enabled to bilaterally constrain excursions of the voice coil/diaphragm assembly.

6. The bidirectional inductive braking system as defined in claim 5 wherein said braking coil enabling means comprises a conductive jumper connected across said pair of terminals so as to short-circuit said braking coil.

7. The bidirectional inductive braking system as defined in claim 5 wherein said braking coil enabling means comprises at least one passive reactive electronic component in a network connected across said pair of terminals so as to influence induced current in the loop in a manner to implement a predetermined frequency-dependent braking/damping characteristic.

8. The bidirectional inductive braking system as defined in claim 5 wherein said braking coil enabling means comprises a feedback driver, connected across said pair of terminals, configured and arranged to apply thereto an active feedback signal, derived in a predetermined relationship from the audio source, so as to interact with induced current in the braking coil in a predetermined manner to enhance braking/damping action of said braking coil.

* * * * *